US010246293B2

(12) United States Patent
Rekieta et al.

(10) Patent No.: US 10,246,293 B2
(45) Date of Patent: Apr. 2, 2019

(54) OFFSHORE HOSE LOADING STATION APPARATUS AND SYSTEM

(71) Applicants: Christopher David Rekieta, Houston, TX (US); Gary Donald Thompson, Broken Arrow, OK (US); Michael Leroy Spence, Houston, TX (US); Benton Frederick Baugh, Houston, TX (US)

(72) Inventors: Christopher David Rekieta, Houston, TX (US); Gary Donald Thompson, Broken Arrow, OK (US); Michael Leroy Spence, Houston, TX (US); Benton Frederick Baugh, Houston, TX (US)

(73) Assignee: Reel Power Licensing Corp., Oklahoma City, OK (US)

( * ) Notice: Subject to any disclaimer, the term of this patent is extended or adjusted under 35 U.S.C. 154(b) by 183 days.

(21) Appl. No.: 15/132,690

(22) Filed: Apr. 19, 2016

(65) Prior Publication Data

US 2016/0311634 A1 Oct. 27, 2016

Related U.S. Application Data

(60) Provisional application No. 62/151,285, filed on Apr. 22, 2015.

(51) Int. Cl.

| | |
|---|---|
| ***B65H 75/42*** | (2006.01) |
| ***B66D 1/26*** | (2006.01) |
| ***B65H 75/44*** | (2006.01) |

(52) U.S. Cl.

CPC ..... *B65H 75/425* (2013.01); *B65H 75/4471* (2013.01); *B65H 75/4481* (2013.01); *B66D 1/26* (2013.01); *B65H 2701/33* (2013.01)

(58) Field of Classification Search

CPC ..... B65H 75/425; B65H 75/4471; B65H 75/4481; B65H 2701/33; B66D 1/26

See application file for complete search history.

(56) References Cited

U.S. PATENT DOCUMENTS

| | | | | |
|---|---|---|---|---|
| 2,008,612 A | | 6/1932 | Heath | |
| 2,345,662 A | * | 4/1944 | Fox | B66D 1/26 254/340 |
| 2,361,858 A | * | 10/1944 | Maginniss | B66D 1/26 254/297 |
| 2,573,868 A | | 11/1951 | Newell | |
| 2,621,870 A | * | 12/1952 | Barton | B65H 75/4481 242/388.8 |
| 3,394,730 A | * | 7/1968 | Sherman | A01G 25/095 137/355.22 |

(Continued)

FOREIGN PATENT DOCUMENTS

| | | |
|---|---|---|
| WO | 01/34934 A2 | 5/2001 |
| WO | 2004/093536 A1 | 11/2004 |

*Primary Examiner* — Michael E Gallion

(74) *Attorney, Agent, or Firm* — Phillips Murrah PC; Martin G. Ozinga

(57) ABSTRACT

The present invention is an apparatus, system and method for use of an offshore hose loading station comprising multiple modular reel assemblies that may be selectively configured to a frame attached to a ship and or vessel wherein the reel assemblies may be powered by one motor and engaged for rotation by one shaft and provides a jumper shaft for when a module is taken out of line.

1 Claim, 9 Drawing Sheets

(56) References Cited

U.S. PATENT DOCUMENTS 3,422,838 A 1/1969 Hedrick
3,614,066 A * 10/1971 Day ..... B66D 1/16 212/84
4,063,690 A * 12/1977 Ouchi ..... B65H 75/4481 242/394.1
4,473,196 A * 9/1984 Sammann ..... B65H 54/56 242/390.5
4,649,954 A * 3/1987 Dunwoody ..... A62C 33/04 137/355.17
6,435,450 B1 * 8/2002 Shields ..... B65H 49/32 242/118.41
8,733,433 B2 * 5/2014 Coles ..... E21B 19/22 166/77.2
9,663,336 B2 * 5/2017 Roodenburg ..... B66D 1/26
2005/0103918 A1 * 5/2005 Bedwell ..... B65H 75/38 242/388.6
2010/0065799 A1 * 3/2010 Zhou ..... B66D 1/22 254/344
2010/0224844 A1 * 9/2010 Boussaton ..... B66D 1/26 254/290
2010/0314132 A1 * 12/2010 Coles ..... E21B 19/22 166/384
2012/0118397 A1 * 5/2012 Novotny ..... E21B 19/22 137/15.01
2014/0199152 A1 * 7/2014 Roodenburg ..... B66D 1/7405 414/800
2014/0217341 A1 * 8/2014 Nam ..... B66D 1/14 254/317
2015/0083843 A1 * 3/2015 Rekieta ..... B65H 75/38 242/394
2015/0144851 A1 * 5/2015 Hoffend, III ..... A63J 1/028 254/278
2015/0284225 A1 * 10/2015 Hall ..... B66D 1/26 254/290
2016/0311634 A1 * 10/2016 Rekieta ..... B65H 75/4471

* cited by examiner

OFFSHORE HOSE LOADING STATION APPARATUS AND SYSTEM

CROSS-REFERENCE TO RELATED APPLICATIONS

The present application claims priority from U.S. Provisional Patent Application Ser. No. 62/151,285, filed on Apr. 22, 2015, and is hereby incorporated by reference herein.

BACKGROUND OF INVENTION

1. Field of the Invention

In general, the present invention relates to a device, system and method for loading offshore vessels utilizing hoses. More particularly, the present invention provides an improved loading station that provides multiple interchangeable reel modules for extremely large hoses associated with sea operations that utilizes one motor for all reel modules, allows for separate running of those modules, and provides a jumper shaft between two non-adjoining reel modules when an adjoining middle module is removed.

2. Description of the Prior Art

Hoses are frequently handled off the side of offshore vessels for the purpose of supplying the offshore vessel with supplies through what are called loading stations. These supplies can simply be liquids such as potable water, oil, diesel fuel, or any of a number of other liquids. Additionally, dry powders are handled thru hoses, such as cement, sand and drilling mud components. Characteristically, when a dry powder is to be transported by a loading station, the powder is mixed with compressed air as a carrying mechanism, much as tubes are frequently used to carry deposits at a drive-in bank. The primary difference is that the bank deposit is in a specific carrier, whereas the dry powder is simply blown to its destination as a loose powder.

These hoses typically range from 3" to 6" in diameter and will usually float. They can be lowered from the side of a first vessel or a dock and can be floated or pulled to a second vessel or dock. Needless to say, these are very large hoses with very long lengths such as 120 meters.

On an installation, there will frequently be several loading stations with individual hoses, which are specifically assigned for a specific service such as diesel fuel or potable water. Each of these will characteristically have a motor attached so that the hose can be lowered down to the water and retrieved back after the task is done. The provision of individual motors with the associated controls is a significant expense when planning for several loading stations, as well as the accommodations of multiple motors consumes extra deck space. Deck space on a large offshore drilling rig is some of the most expensive "real estate" in the world.

Still further, the reels associated with these loading stations require maintenance. By example, it is not unusual for a hose to break which would require removing the reel module associated with that hose. In the prior art, this often requires a cumbersome and time consuming operation of stopping all operations of modules while one is being replaced In spite of the cost associated with the present products as well as the real estate consumed by the multiplicity of motors, prior art attempts at improvements to this problem have not provided the desired solutions. Thus, there is a need for an apparatus, process and or system that provides a loading station that only requires one motor for all reel modules as well as provides a means to operate the individual modules even when a module is removed from the drive train.

The above discussed limitations in the prior art is not exhaustive. The current invention provides an inexpensive, time saving, more reliable apparatus, method and system for offshore hose loading stations where the prior art fails.

SUMMARY OF THE INVENTION

In view of the foregoing disadvantages inherent in the known types of loading systems for offshore hose applications now present in the prior art, the present invention provides a new and improved apparatus, system and method of using an offshore hose loading station. As such, the general purpose of the present invention, which will be described subsequently in greater detail, is to provide a new and improved loading station for use with offshore application which has all the advantages of the prior art devices and none and or fewer of the disadvantages.

It is, therefore, contemplated that the present invention is an apparatus, system and method for use of an offshore hose loading station comprising multiple hose reels that may be selectively configured to a frame attached to a ship and or vessel. The multiple hose reels may be powered by one motor and engaged for rotation by one shaft. Each reel may have an engaging clutch to the shaft for selective rotation of a separate hose reel as desired. The loading station may further be adapted to provide a jumper shaft between two non-adjoining reel modules when an adjoining middle module is removed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved offshore hose loading station for use in transferring fluids, powders, and so forth at sea from one location to another utilizing a plurality of different hoses stored on motor driven reels.

Furthermore, an object of the present invention is to provide a new and improved offshore hose loading station apparatus, system and method, which allows for a single motor to drive multiple reels independently and reliably.

Another object of the present invention is to provide a new and improved offshore hose loading station, which may include a clutch that will allow any of several loading stations to be powered by a single motor, prevents the accidental uncoiling of the loading station hose when it is not being powered, and provides no time of disengagement thereby eliminating and or decreasing accidental losing of a hose.

It is a further object of the present invention to provide a new and improved offshore hose loading station apparatus, system and method, which is of a durable and reliable construction and may be utilized in numerous types of applications.

An even further object of the present invention is to provide a new and improved offshore hose loading station apparatus, system and method, which is susceptible to a low cost of installation and labor, which accordingly is then susceptible to low prices of sale to the consuming industry, thereby making such a system economically available to those in the field.

Still another object of the present invention is to provide a new and improved offshore hose loading station apparatus, system and method, which provides all of the advantages of the prior art while simultaneously overcoming some of the disadvantages normally associated therewith.

It is a further object of the present invention to provide a new and improved offshore hose loading station apparatus, system and method that provides a jumper shaft that may be utilized between two non-adjoin reel modules when an adjoin middle module is removed.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings and appendices.

DETAILED DESCRIPTION OF INVENTION

Figure 1:
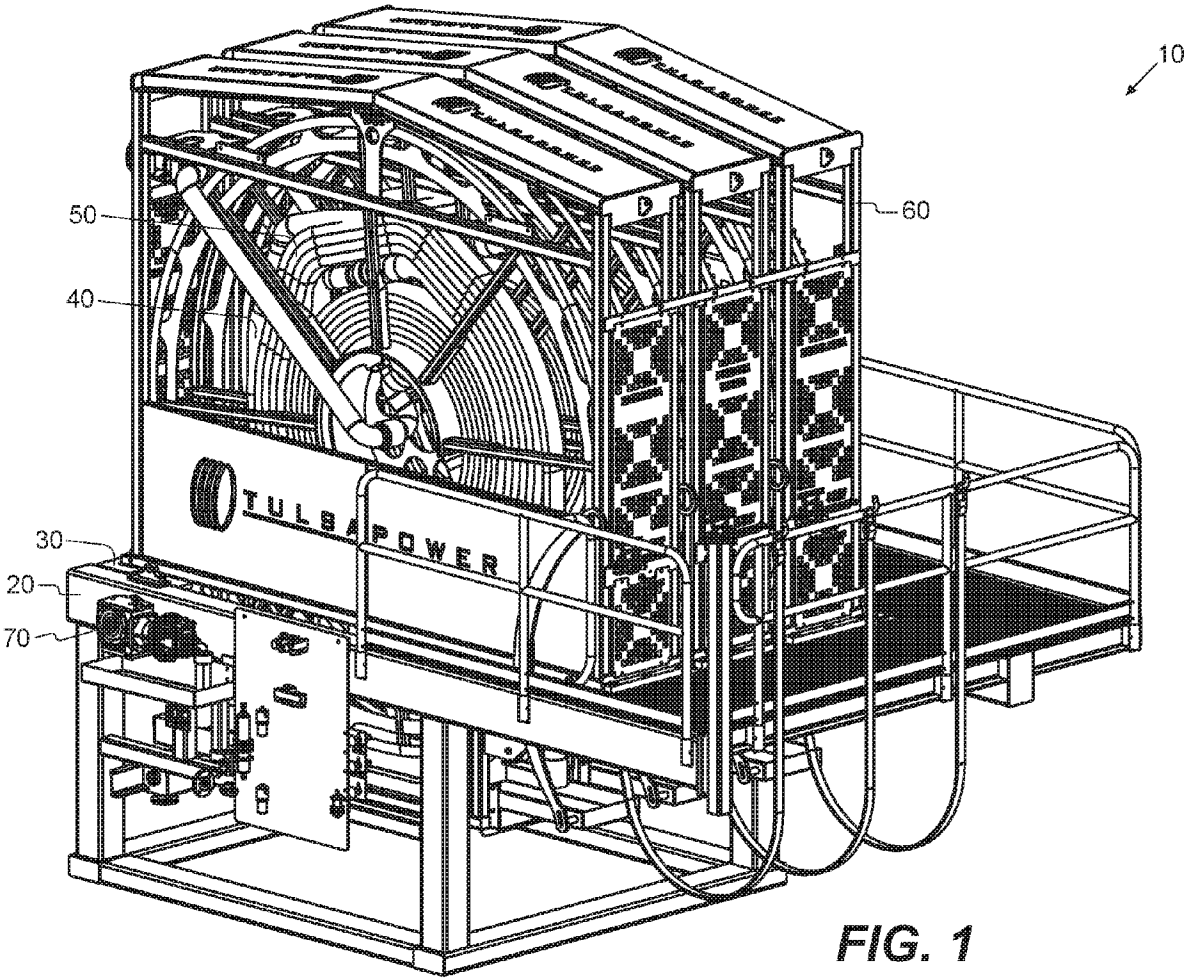
FIG. 1 is a general illustration of a preferred embodiment in accordance with the invention depicting a perspective view of a loading station with three modular reel assemblies in position.
Figure 2:
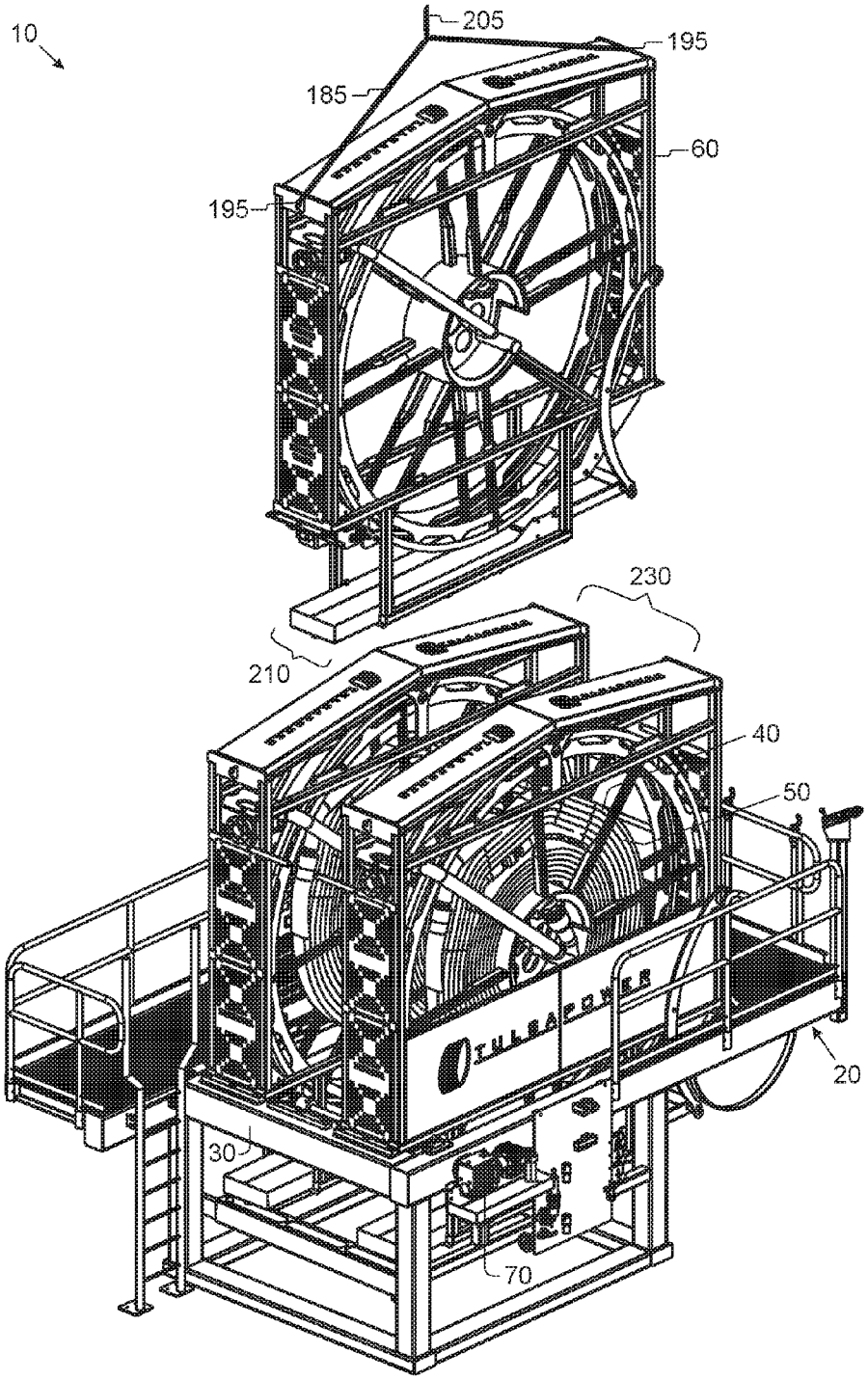
FIG. 2 is a general illustration of a preferred embodiment in accordance with the invention depicting a perspective view of the loading station in FIG. 1 from the other or back side with a modular reel assembly being lifted off frame of the loading station.

Referring to the illustrations, drawings, and pictures and to FIGS. 1 and 2 in particular, reference character 10 generally designates a new and improved offshore hose loading station apparatus, system and method of using same constructed in accordance with the present invention. Invention 10 is generally used in offshore transfer of such things as liquids such as but not limited to potable water, oil, diesel fuel and so forth. Invention 10 may also be utilized to transfer dry powders such as but not limited to cement, sand and drilling mud components. It is to be understood that invention 10 may be utilized for non-offshore applications and may be utilized in other operations not associated vessels. For purposes of convenience, the reference numeral 10 may generally be utilized for the indication of the invention, portion of the invention, preferred embodiments of the invention and so on. It is also to be understood that invention 10 should not be considered limited to just loading stations and may be utilized with other types of reel and or spool assemblies.

Loading Station and Modular Reel Assembly

In a preferred embodiment, invention 10 may further include loading station 20 having a frame 30 for holding a number of spool(s) 40 with associated hose(s) 50. Invention 10 also contemplates a modular reel assembly 60 for positioning hose 50 and spool 40. Modular reel assembly 60 is generally modular for removably attaching to frame 30 as desired thus generally allowing customization by the order of units, number of units, placement and so forth on frame 30.

Modular reel assembly 60 may be removably attached to frame 30 such as but not limited to removable bolts and other forms of attachment known in the art. It is understood that frame 30 may be adapted to be attached to a sea vessel, offshore platform and so forth. It is understood that it is contemplated to attach frame 30 to a deck of a ship.

It is further contemplated that loading station 20 may include numerous variations of modular reel assembly 60 and associated spool 40 for holding associated hose 50 other than that depicted for convenience. It is understood that invention 10 contemplates more or less modular reel assembly 60 and the current invention should not be limited to the illustrations. A preferred construction may be two and or up to twelve modular reel assembly 60 although more may be contemplated than twelve.

Figure 3:
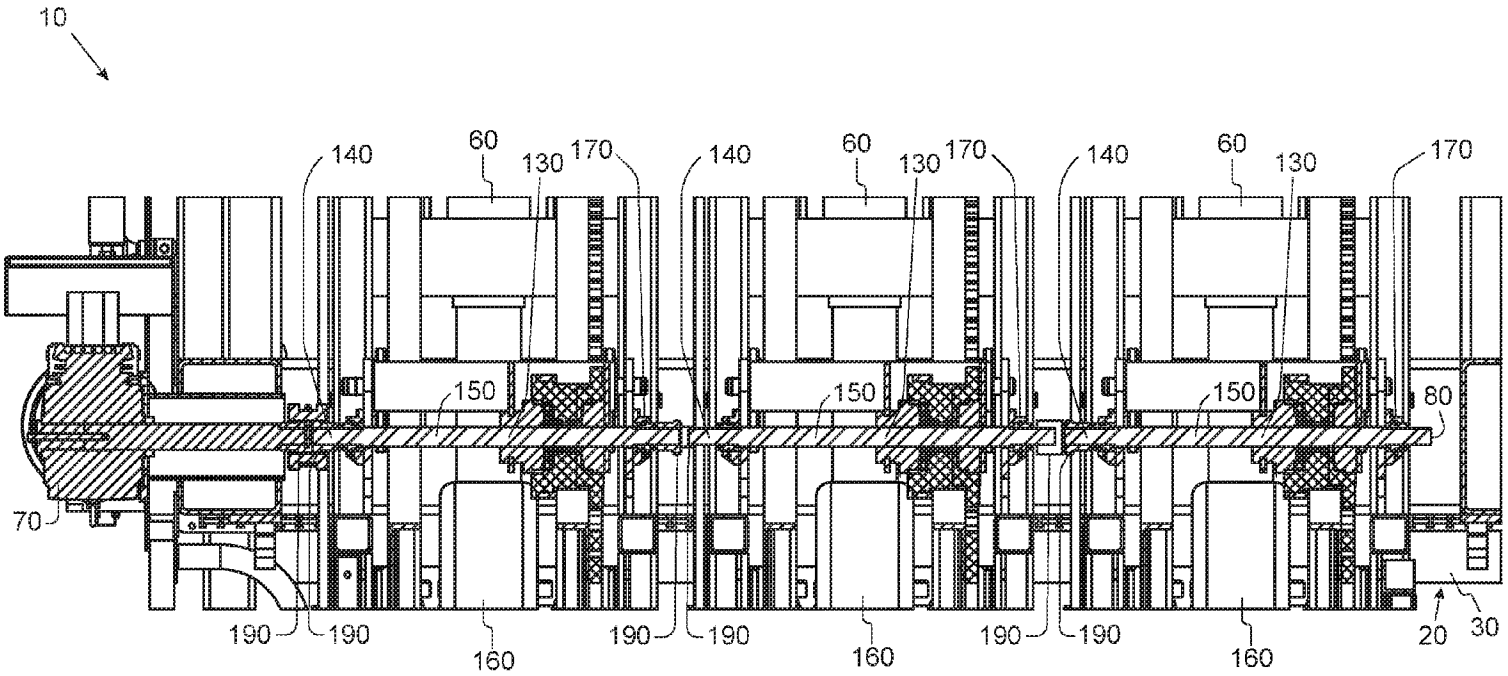
FIG. 3 is a general illustration of a preferred embodiment in accordance with the invention depicting a bottom partial cut away view of the loading station in FIG. 1.

Again referring to the illustration in general and more in particular to FIGS. 3 and 4, invention 10 contemplates loading station 20 may function to provide independent modular reel assembly 60 and associated operation of spool 40 with one motor 70 wherein motor 70 is connected to one or more modular reel assembly 60 spool 40 via shaft and or shaft assembly 80 as further described below. Invention 10 may provide a clutch and or clutch assembly 90 per modular reel assembly 60 of numerous types and or other mechanical applications known in the art may be utilized. In a preferred embodiment, motor 70 may be located in on side of frame 30 for access. Motor 70 may be on various positions on frame 30 and the current invention should not be considered to limit the invention as illustrated.

Figure 4:
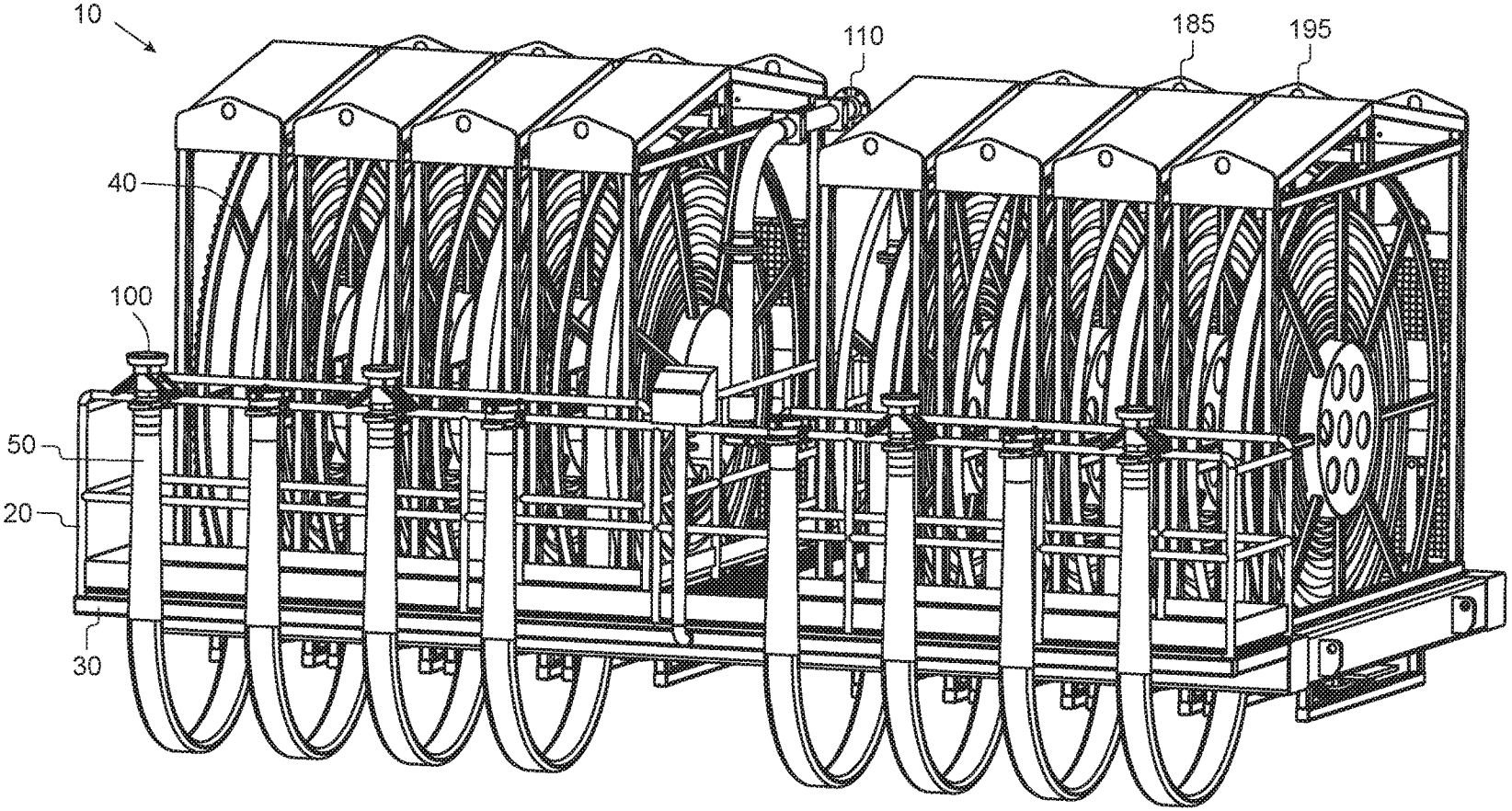
FIG. 4 is a general illustration of a preferred embodiment in accordance with the invention depicting a perspective view of a loading station with positions for nine modular reel assemblies with one generally removed.

Referring to FIG. 4, loading station 20 is generally depicted to show another configuration of modular reel assembly 60 on common frame 30, each having hose 50 such with an output connector 100 on seaside to be deployed to deliver product to a vessel or port. It is understood that hose 50 is typically made from various materials known in the art and of great length such as but not limited to 120 meters. It is understood that various types of materials may be utilized at various lengths for hose 50.

Figure 5:
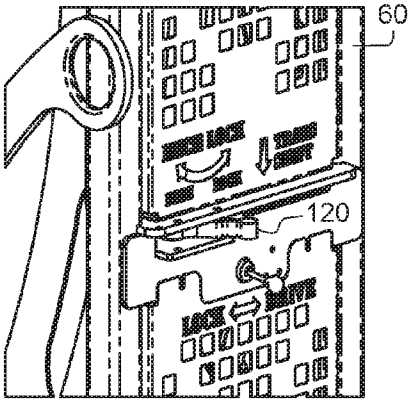
FIG. 5 is a general illustration of a preferred embodiment in accordance with the invention depicting a partial perspective view of a modular reel assembly control panel.

Referring now to FIG. 5 and in more particular, generally the opposite side of the illustration depicting the other side and or inboard side of modular reel assembly 60. It is understood that each modular reel assembly 60 may be operated independently from other units and has a fitting such as input connector 110 for connection of piping to administer the fluid or powder to be received or delivered. Handle 120 may operate clutch 90 of this invention. It is understood that handle 120 may cooperate with a power source (not depicted) such as but not limited to electric, pneumatic, hydraulic and so forth to power assist the operation of handle 120, clutch assembly 90, and so forth.

Figure 6:
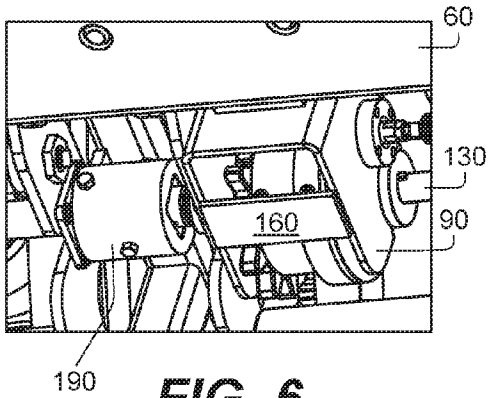
FIG. 6 is a general illustration of a preferred embodiment in accordance with the invention depicting a partial perspective view of bottom of a modular reel assembly drive, clutch, spool gear, connector and so forth.
Figure 9:
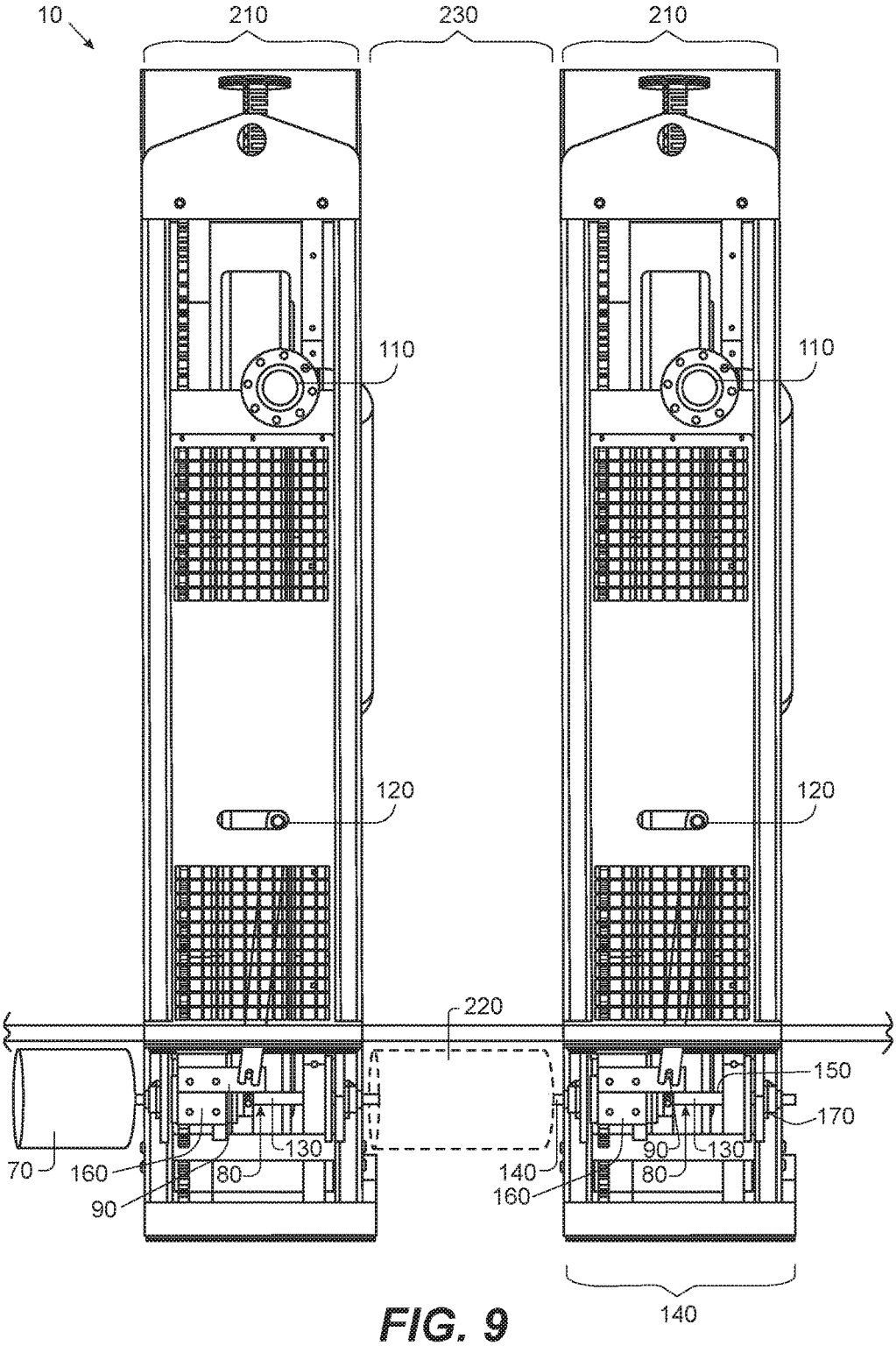
FIG. 9 is a general illustration of a preferred embodiment in accordance with the invention depicting a front view of two modular reel assemblies in position on a loading station frame with a generic motor and jumper shaft.
Figure 10:
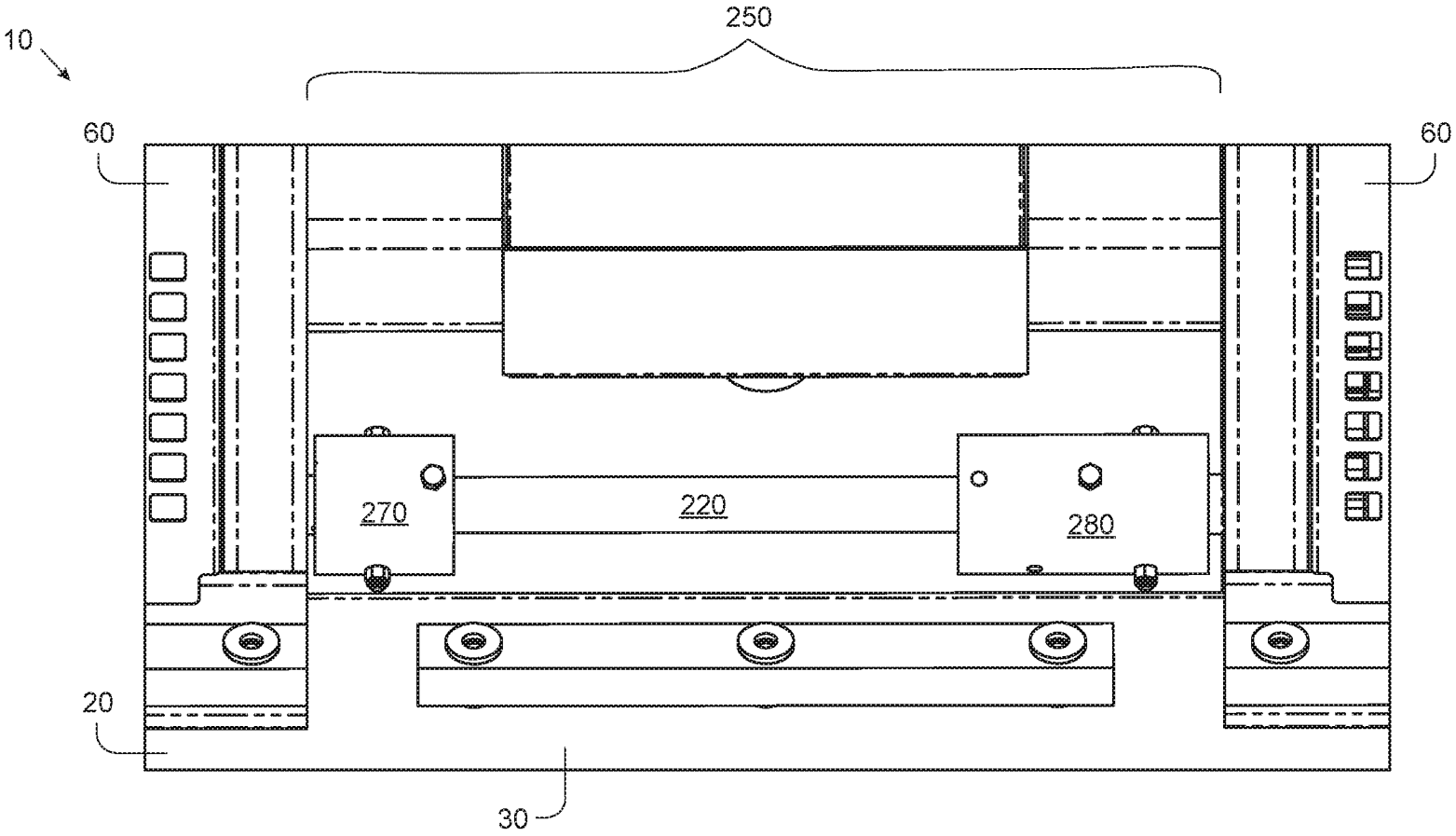
FIG. 10 is a general illustration of a preferred embodiment in accordance with the invention of FIG. 9 depicting a jumper shaft attached between two modular reel assemblies on a loading station frame.
Figure 11:
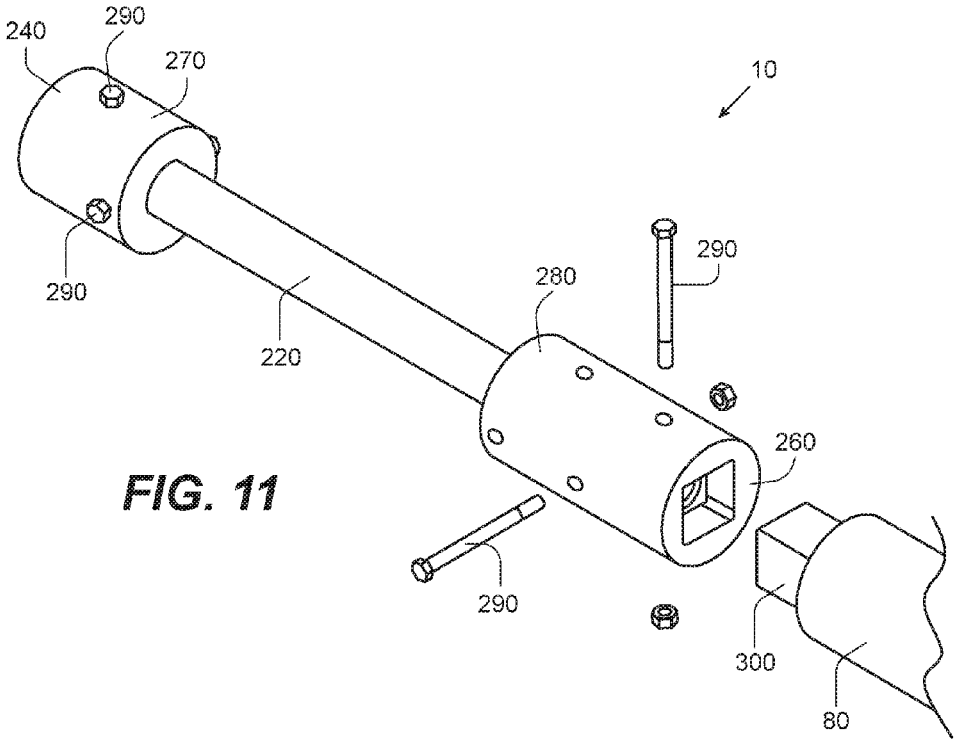
FIG. 11 is a general illustration of a preferred embodiment in accordance with the invention depicting a partial exploded perspective view of a jumper shaft ready for attachment.
Figure 12:
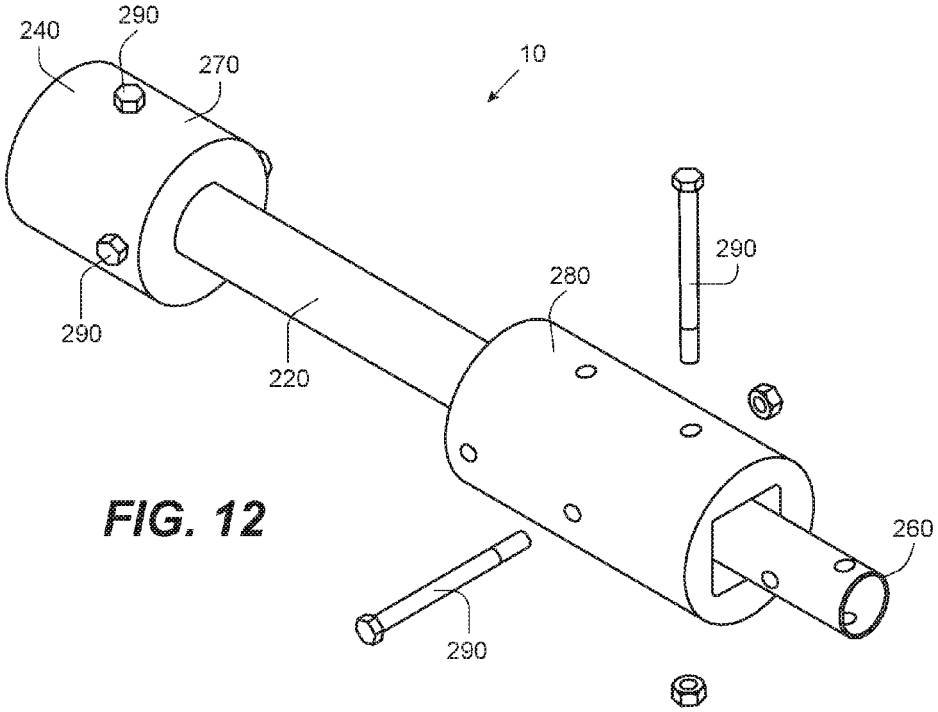
FIG. 12 is a general illustration of a preferred embodiment in accordance with the invention of FIG. 11 depicting a partial exploded perspective view of a jumper shaft positioned to be aligned for attachment.

Again Referring to FIG. 3 and also FIG. 6, a bottom view of the group of modular reel assembly 60 on loading station 20 is depicted showing single motor 70 to drive the individual modular reel assembly 60 interconnected shaft assembly 80, associated respective clutch assembly 90 and drive assembly 160 also discussed further below. Single motor 70 provides the power to operate all of loading station 20 individual modular reel assembly 60 simultaneously or one at a time.

Shaft assembly 80 is generally a reference to one or more individual and interchangeable segment(s) 130 for each modular reel assembly 60 that comprise shaft assembly 80 that is in communication with motor 70 for selectively rotating respective spool 40 of a modular reel assembly 60 for winding and unwinding hose 50 on spool 40 when assembled and or connected. Invention 10 contemplates that each segment 130 has a first end 140, a middle 150 with disposed clutch 90 and drive assembly 160 to rotate spool 40 for selectively rotating spool 40, and a second end 170. It is understood that drive assembly 160 may generally take the rotation of shaft 80 and translate into rotation of spool 40 on modular reel assembly 60 as known in the art with associated gearing and as depicted but not limited thereto.

Figure 7:
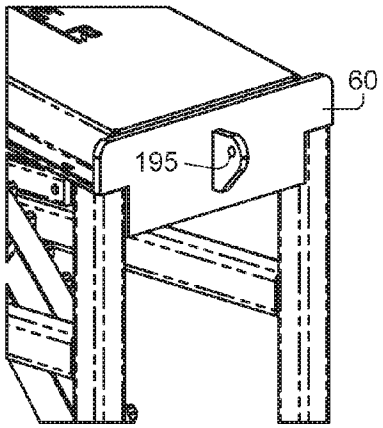
FIG. 7 is a general illustration of a preferred embodiment in accordance with the invention depicting a partial perspective view of modular reel assembly top portion and lifting point.
Figure 8:
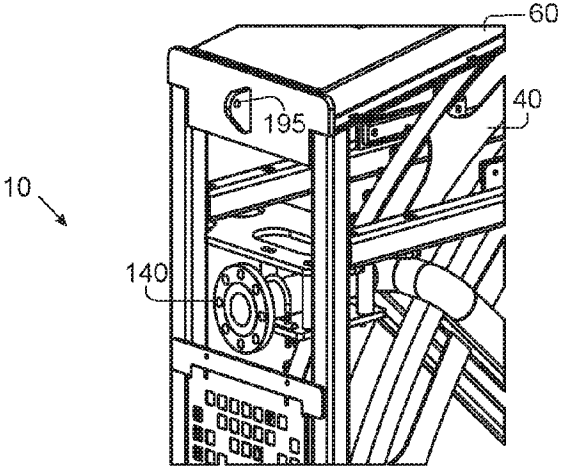
FIG. 8 is a general illustration of a preferred embodiment in accordance with the invention depicting a partial perspective view of modular reel assembly top portion and lifting point.

Referring more in particular to FIGS. 7 and 8, it is understood that each modular reel assembly 60 is adapted to be removably placed on loading station 20 frame 30 and connected to each other modular reel assembly 60 such that wherein shaft 80 is operable to all modular reel assembly 60. Each modular reel assembly 60 may be removably connected by bolts to frame 30 as known in the art and may include lift assembly 185 that may be but is not limited to, slings, hooks, lift lugs and so forth for lifting from frame 30 and also lowering to said frame 30. Each modular reel assembly 60 may have lift points 195 to attach such as but not limited to a cable and or rope 205 and so forth.

It is understood that the respective segments 130 are removably connectable such that one segment 130 may be removed allowing each modular reel assembly 60 to be replaced and or placed and shaft 80 reassembled and or reconnected. In a preferred embodiment, segments 130 first end 140 and second end 170 may include a keyway 180 that is more clearly depicted in FIG. 15 that may utilize a removable coupler and or coupling 190 for removably connecting shaft assembly 80 together. Motor 70 may also include keyway 180 that may also be utilized with removable coupler 190 for removably connecting to modular reel assembly 60 segment 130. It is understood that segment(s) 130 have a length 200 that generally form shaft assembly 80 when connected by coupler(s) 190 to motor 70. Length 200 is about the same as width 210 of modular reel assembly 60.

It is understood that shaft assembly 80 segments 130 may be removably attached to each other and motor 70 in various ways and the current invention should not be limited to the current illustrations. Couplers 190 in the art may be and have pins, collars, sleeves, squared drives, combinations thereof and other forms known in the art to removably attach two rotating shafts.

Jumper Shaft

Again referring to the illustrations in general and more in particular to FIGS. 9 through 13, invention 10 contemplates providing one or more auxiliary and or jumper shaft 220 such that shaft assembly 80 may be in full communication with all modular reel assemblies 60 and motor 70 when modular reel assembly 60 is removed from frame 20 and a gap 230 is formed by the removal of the modular reel assembly 60 segment 130 from the shaft assembly 80. Gap 230 is approximately the same as segment 130 length 200, which is also approximately the same as width 210 of modular reel assembly 60. It is understood that jumpers shaft 220 may be utilized for gap 230 between modular reel assembly 60 and or gap 230 between motor 70 and a modular reel assembly 60. It is understood that multiple jumper shaft 220 may be utilized if more than one modular reel assembly 60 segment 130 is removed from shaft assembly 80.

Jumper shaft 220 has a first end 240, a length 250, and a second end 260. Jumper shaft 220 length is generally the same length as segment 130 length 220 of shaft assembly 80. First end 240 and second end 260 are adapted to be removably connected to segments 130 first end 140, second end 130 and or motor 70.

In a preferred embodiment, either jumper shaft 220 first end 240 or second end 260 may include a generally fixed connector 270 and a sliding connector 280. It is contemplated to remove bolts 290 from jumper shaft 220 slider connector 280 allowing sliding connector 280 to generally travel down length 250 toward fixed connector 270, which allows clearance for connecting. Fixed connector 270 may be slipped onto, attached, and or removably attached to segment 130 after being aligned to segment 130 and or motor 70. After alignment sliding connector 280 is positioned for connecting to another segment 130 and or motor 70 and may be slipped onto, attached and or removably attached and so forth. In a preferred embodiment, sliding connector 280 is slid into position and bolted into place with bolts 290. In another preferred embodiment, square coupling 300 may be utilized to connect jumper shaft 220. It is understood that numerous variations are contemplated for the removable installment and or non-removable installment of jumper shaft 220.

Adapter for Manually Rotating Spool

Figure 16:
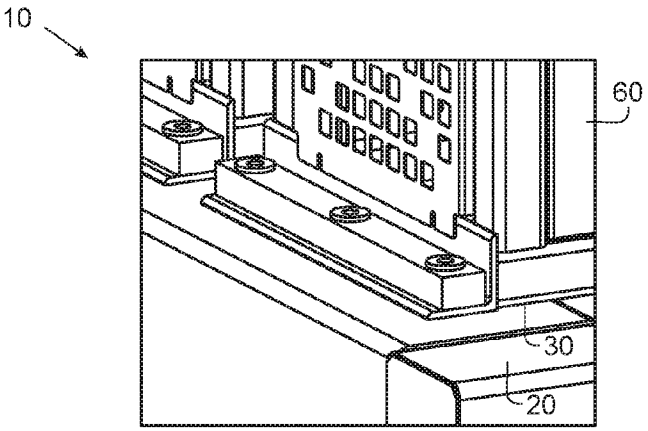
FIG. 16 is a general illustration of a preferred embodiment in accordance with the invention depicting a partial perspective view of a modular reel assembly bolted onto a frame of a loading station.
Figure 15:
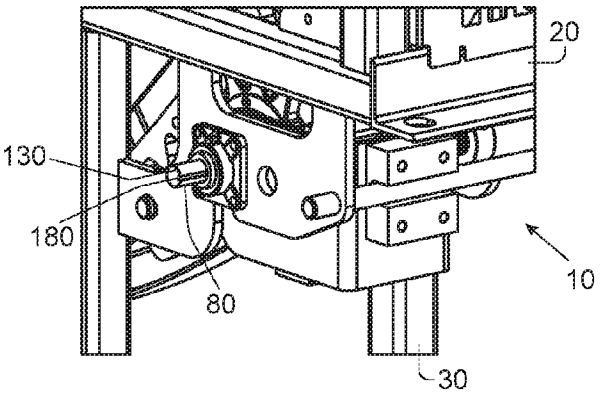
FIG. 15 is a general illustration of a preferred embodiment in accordance with the invention depicting a partial perspective view of a shaft for use with adapter of FIG. 14 and also generally depicting a keyway end.
Figure 13:
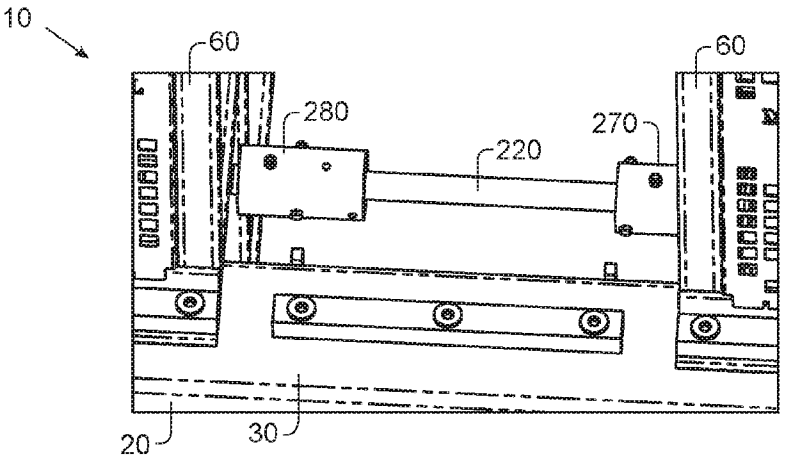
FIG. 13 is a general illustration of a preferred embodiment in accordance with the invention of FIG. 10 depicting a partial perspective view of jumper shaft being attached and or removed between two modular reel assemblies on a loading station frame with one end uncoupled.
Figure 14:
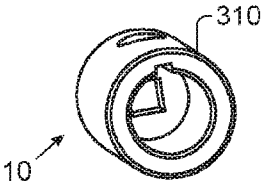
FIG. 14 is a general illustration of a preferred embodiment in accordance with the invention depicting a perspective view of an adapter and or socket for attaching to manually rotate a spool with a wrench, ratchet and so forth.

Referring more specifically to FIGS. 14, 15 and 16, invention 10 contemplates providing and adapter and or socket 310 which may be attached to segment 130 first end 140 and or second end 140 for allowing rotation of spool 40 when modular reel assembly 60 has been removed from shaft assembly 80 during movement out of and or in frame 30 of loading station 20. In a preferred construction, segment 130 keyway 180 and or motor 70 keyway 180 may be fitted to socket 310 wherein a ratchet, wrench, and or other tool may be provided to manually rotate spool 40. It is understood that numerous configurations are contemplated to allow the rotation of spool 40 via segment 130 rotation.

Preferred Embodiments

Invention 10, therefore, contemplates a loading station for transferring supplies via a hose adapted to be pulled from a first sea vessel or first dock to a second sea vessel or second dock comprising: a modular reel assembly having a spool adapted to rotate to wind and unwind said hose from said first sea vessel or first dock to said second sea vessel or second dock and wherein said spool is rotated by a rotating shaft segment having a first end, a second end and a length; a motor having a rotating shaft with an end; and a jumper shaft having a first end removably attached to said end of said rotating shaft of said motor, a second end removably attached to said first end of said rotating shaft segment of said modular reel assembly, and a length wherein said length of said jumper shaft is about the same as said length of said shaft segment of said modular reel assembly.

Invention 10 also further contemplates a loading station for transferring supplies via a first hose and a second hose wherein said first hose and said second hose are adapted to be pulled from a first sea vessel or first dock to a second sea vessel or second dock comprising: a first modular reel assembly having a spool adapted to independently rotate to wind and unwind said first hose from said first sea vessel or first dock to said second sea vessel or second dock and wherein said spool is rotated by a rotating shaft segment having a first end, a second end and a length; a second modular reel assembly having a spool adapted to independently rotate to wind and unwind said second hose from said first sea vessel or first dock to said second sea vessel or second dock and wherein said spool is rotated by a rotating shaft segment having a first end, a second end and a length; a motor having a rotating shaft with an end in communication with said first end of said rotating shaft segment of said first modular reel assembly; and a jumper shaft having a first end removably attached to said second end of said rotating shaft segment of said first modular reel assembly, a second end removably attached to said first end of said rotating shaft segment of said second modular reel assembly, and a length wherein said length of said jumper shaft is about the same as said length of said shaft segment of said first modular reel assembly.

Invention 10 still further contemplates a loading station for transferring supplies via a first hose and a second hose wherein said first hose and said second hose are adapted to be pulled from a first sea vessel or first dock to a second sea vessel or second dock comprising: a first modular reel assembly having a spool adapted to independently rotate to wind and unwind said first hose from said first sea vessel or first dock to said second sea vessel or second dock and wherein said spool is rotated by a rotating shaft segment having a first end, a second end and a length; a second modular reel assembly having a spool adapted to independently rotate to wind and unwind said second hose from said first sea vessel or first dock to said second sea vessel or second dock and wherein said spool is rotated by a rotating shaft segment having a first end, a second end, a length, and wherein said first end of said rotating shaft segment is in communication with said second end of said rotating shaft segment of said first modular reel assembly; and a motor having a rotating shaft with an end in communication with said first end of said rotating shaft segment of said first modular reel assembly.

Changes may be made in the combinations, operations, and arrangements of the various parts and elements described herein without departing from the spirit and scope of the invention. Furthermore, names, titles, headings and general division of the aforementioned are provided for convenience and therefore, should not be considered limiting.

What is claimed is:

1. A loading station for transferring supplies via a first hose and a second hose wherein said first hose and said second hose are adapted to be pulled from a first sea vessel or first dock to a second sea vessel or second dock comprising:

a jumper shaft having a first end, a length, and a second end;

a first modular reel assembly having a spool adapted to independently rotate to wind and unwind said first hose from said first sea vessel or first dock to said second sea vessel or second dock and wherein said spool is rotated by a first rotating shaft segment having a first end, a second end attached to said first end of said jumper shaft, and a length;

a second modular reel assembly having a spool adapted to independently rotate to wind and unwind said second hose from said first sea vessel or first dock to said second sea vessel or second dock and wherein said spool is rotated by a second rotating shaft segment having a first end attached to said second end of said jumper shaft, a second end, and a length;

a motor having a third rotating shaft with an end in communication with said first end of said first rotating shaft segment of said first modular reel assembly;

wherein said first rotating shaft, said second rotating shaft and said third rotating shaft are linearly aligned; and wherein said length of said first rotating shaft, said length of said second rotating shaft, and said length of said jumper shaft are the same.

* * * * *